US006904642B2

(12) United States Patent
West

(10) Patent No.: US 6,904,642 B2
(45) Date of Patent: Jun. 14, 2005

(54) CLOSING DEVICE FOR GATES AND DOORS

(75) Inventor: James David Francis West, Terrey Hills (AU)

(73) Assignee: D&D Group Pty Limited, Brookvale (AU)

( * ) Notice: Subject to any disclaimer, the term of this patent is extended or adjusted under 35 U.S.C. 154(b) by 45 days.

(21) Appl. No.: 10/450,339

(22) PCT Filed: Jan. 15, 2002

(86) PCT No.: PCT/AU02/00040

§ 371 (c)(1),
(2), (4) Date: Jun. 10, 2003

(87) PCT Pub. No.: WO02/055820

PCT Pub. Date: Jul. 18, 2002

(65) Prior Publication Data

US 2004/0020127 A1 Feb. 5, 2004

(30) Foreign Application Priority Data

Jan. 15, 2001 (AU) ..... PR2516

(51) Int. Cl.[7] ..... E05F 11/00
(52) U.S. Cl. ..... 16/50; 49/333; 16/49
(58) Field of Search ..... 16/49, 50, 54, 16/58, 66, 68, 86.1, 376, 382, 77, DIG. 10, 84; 256/73, 65.13, 65.02–65.05, 65.14; 292/198, 340, 341.17, DIG. 15; 49/339, 326, 333, 348

(56) References Cited

U.S. PATENT DOCUMENTS 3,751,759 A * 8/1973 Duncan ..... 16/50
4,026,069 A * 5/1977 Bohnett ..... 49/49
4,285,165 A * 8/1981 Persson ..... 49/30
5,622,006 A * 4/1997 Collins ..... 49/386
6,327,818 B1 * 12/2001 Pease ..... 49/49
6,725,504 B1 * 4/2004 Dickson et al. ..... 16/236

FOREIGN PATENT DOCUMENTS

| | | | |
|---|---|---|---|
| DE | 372 917 | | 4/1923 |
| FR | 2 751 020 | | 1/1998 |
| GB | 2065219 A | * | 6/1981 |
| JP | 05-005389 | * | 1/1993 |

* cited by examiner

*Primary Examiner*—Robert J. Sandy
*Assistant Examiner*—Andre' L. Jackson
(74) *Attorney, Agent, or Firm*—Kelly Lowry & Kelley, LLP

(57) ABSTRACT

A closer device for a gate such as a swimming pool gate has relatively rotatable arms (for connection respectively to a gate and gate post), the arms being connected to a closer body having an axis parallel to the hinging axis of the gate on the gate post. The closer body has an elongate piston mounted within cylindrical gas chambers on respective sides of the piston and a relief profile on the exterior of the cylinder to engage with respective mounting elements for the arms whereby, upon relative rotation of the arms responding to gate movement, the piston moves axially within the gas chambers and a spring within the body urges the piston towards the position corresponding to a gate closed position. A gas controller permits unrestricted opening of the gate and control of closing speed.

20 Claims, 8 Drawing Sheets

CLOSING DEVICE FOR GATES AND DOORS

FIELD OF THE INVENTION

The present invention relates to a closing device for gates, doors and the like. It is particularly applicable to applications which are demanding and require reliable long term closure operation such as is required for swimming pool gates where safety is paramount and there is exposure to the weather. However, devices embodying the invention may be applied to other uses.

BACKGROUND OF THE INVENTION

Automatic door closers are known. Generally they comprise a body portion adapted to be mounted to either a door post or the door and an arm mechanism adapted to be pivotally connected to the other of the door post and the door. When a door is opened, a spring system is loaded to store energy ready for closing the door when it is released. Usually, a damping mechanism is provided to control the speed of door closure. For example, the body portion may contain a chamber with a bleed screw and the arm mechanism connects to a piston within the chamber, the arrangement being such that closure operates against the resistance of air, the escape of which through the bleed screw permits the mechanism to close.

One example of a prior published door closer is that of Korean Specification No 97-7637 which proposes a cylindrical housing which receives a hinge shaft engaging with a piston element which is threadibly engaged on the hinge shaft and retained such that upon relative rotation the piston is driven down the cylindrical housing, thereby compressing a helical return spring. The housing has air chambers either side of the piston with a bleed valve arrangement to buffer return motion under the influence of the helical compression spring which has been compressed upon opening of the associated door.

Another prior proposal is that of International Patent Publication WO 99/54583 (Shin) which is a hinged type automatic door closer providing a cylindrical housing to be mounted on a door via a plate and accommodating a hinge shaft which is mounted on a door frame via a mounting plate. A helical threading is provided on the hinge shaft and engages with a guided piston which moves axially along the housing upon rotational movement corresponding to a door being opened. The helical compression spring below the piston is compressed. This door closer relies on a hydraulic damping system.

The prior art referred to has been published, but no admission is made that in any particular country, this art is generally known or used.

For many applications the present inventor considers that the prior art proposals have limitations and new and useful alternatives are needed to provide consumer choice with functionality and performance not hitherto available. Embodiments of the invention are especially applicable to installation such as swimming pool gates and preferred embodiments of the invention incorporate distinct and separate inventive concepts which can provide novel and useful simplified structures useful for various applications.

SUMMARY OF THE INVENTION

According to a first aspect of the present inventive subject matter, there is provided a closing device for a hinged gate or the like and having a body portion and pivotal arms for connection directly or indirectly to a gate and gate post through respective mounting means being relatively rotational about an axis which is adapted to be parallel to the axis of hinging of the gate, the body portion and the arms being relatively rotational through a range of positions extending from a gate closed position through to a fully open position (which can be up to approximately 180° spaced around the axes from the closed position), this being provided for by the geometry and dimensions of the respective pivotal arms and the mounting means of the device, one of the arms having mounting means in the form of a pivotal connection to a mounting arm which is adapted to be connected to either the gate or a gate post, the body portion having a cylindrical piston with an external grooved profile with a helical groove pattern and an axial groove pattern, a first of the arms having a helical ribbed mounting portion for mounting the arm for rotation of the arm about the piston as the piston moves axially and the second of the arms having an axially ribbed mounting element to engage the piston and guide its axial displacement during relative rotation of the pivotal arms, the body portion further providing a cylindrical housing for the piston with fluid chambers on each side of the piston, resilient closing means to cause the gate to close when released in the open position and speed control means for controlling the speed of closure of the gate by controlling fluid flow between opposite sides of the piston.

Preferably, the device supplied includes the mounting means, whereby when installed the pivotal axes comprise: (a) the hinge axis of the gate and gate post, (b) the axis of the body portion of the device and (c) two pivot axes associated with the mounting means, the respective axes being parallel to one another.

In one embodiment said two pivot axes are respectively provided at free ends of the respective pivotal arms where pivot connections to respective mounting arms for the gate and gate post are provided.

However, in an alternative embodiment which may be preferred for some applications at least, one of the pivotal arms is directly fixed to the gate or gate post and the other pivotal arm is pivotally connected at its free end to an intermediate pivot arm which at its other end is pivotally connected to a mounting arm which mounts to the other of the gate and gate post.

To facilitate installation, most preferably the gate post mounting arm includes an intermediate portion providing for adjustment of the first end portion relative to the second end portion whereby the axis of pivotal connection to the second arm can be altered relative to the gate post to suit the particular installation required.

Embodiments utilising the first aspect of the invention may be described as comprising a four-bar mechanism. Thus, as a complete unit supplied for installation, it is most convenient for the device to be supplied with a suitable pivotal mounting arms.

In a second and distinct inventive aspect of the present subject matter, there is provided a closing mechanism for use in a gate closer device, the mechanism including a cylindrical shaft having a spiral relief profile and an axial relief profile formed around the surface, an axially ribbed guide element adapted to engage with the relief profile and permit relative axial displacement of the shaft, and a complimentary nut element arranged to engage with the spiral relief profile whereby rotational movement of the nut causes axial displacement of the shaft and relative rotation of the guide element and the nut, the shaft being mounted in a cylinder with a spring which is energised by displacement of the shaft in a first axial direction, the spring thereby providing a restoring force to move the shaft in the opposite direction, and a fluid system associated with the shaft and cylinder and having a fluid bleed system configured to control the speed of return motion of the shaft under influence of the spring, the guide element and the nut being adapted to have connection arms to be connected to the gate and gate post.

Preferably the fluid system is a closed gas system such as one using air with a piston.

A preferred embodiment of the invention is one in which a compact, economic, durable, reliable and safe gate closing mechanism is provided for safe mounting between e.g. an outwardly opening swimming pool gate and its associated gate post.

A preferred embodiment is one in which opening well beyond 90° and up to 180° is permitted to provide clear access to the gate opening when the gate is open and to prevent damage to the closer by forced opening of a gate beyond the limit of the closer.

Particularly where opening to about 180° is permitted by virtue of the mounting structure, an auxiliary spring system is best incorporated to initiate closing since the primary spring system of the device may be inadequate to commence closing because the arms have reached a centre or even over-centre position. Such a spring mechanism can be incorporated between an arm which connects to the gate and the gate structure.

Preferably, embodiments of the invention incorporate an override device whereby any manual attempt to close the gate at a speed greater than that selected for automatic closure causes a valve mechanism to open thereby providing rapid additional fluid flow between opposite sides of the piston.

In one important embodiment, in general terms, the invention can be defined as a closing device for a gate having:

(a) a body portion, (b) a central axis of the body portion adapted to be located parallel to the hinge axis of the gate when in use, (c) first and second mounting arms extending from first and second relatively rotational portions of the body portion, the mounting arms having respective connector portions for connection respectively to a gate and a gate post, (d) the first and second portions of the body portion being relatively rotatable about the central axis, (e) the body portion having a cylinder with an axially moveable elongate piston in sealing engagement with an inner wall of the cylinder and the piston being adapted to be connected to the body portions to be driven axially upon relative rotational motion of the body portions, (f) gas containing chambers being defined on opposite sides of the piston, (g) a spring mounted to be loaded during axial motion of the piston corresponding to rotation of the gate to an open position whereby on release of the gate, the spring biases the piston in a reverse direction, and (h) valve means provided for controlling the speed of the piston and thus closure of the gate when under bias from the spring, the valve means providing relatively free gas flow through the piston during gate opening and compression of the spring, and controlled gas flow for speed control during closing of the gate under spring pressure.

A preferred embodiment is one in which the piston has a piston head and a depending skirt portion with ring seals provided around the piston, and the piston head incorporating a gas bleed screw to function as a speed control and a flap valve to permit unrestricted gas flow during gate opening.

Preferably, the piston head also incorporates a relief valve which opens to permit essentially unrestricted gas flow through the piston if the gate is manipulated positively at high speed towards the closed position.

Preferably, the spring is in the form of a helical compression spring mounted over a mounting spigot and extending within the skirt of the piston, the spigot reducing the gas space within the cylinder on the spring side of the piston.

The central element preferably includes an annular element with an interior structure to engage with a complementary structure on the periphery of the depending skirt of the piston whereby relative rotation of the annular element drives the depending skirt and the piston axially, the skirt having inter-engaging splines with the interior of the cylinder portions whereby its action is controlled to be purely axial; two gas chambers are defined on respective sides of the piston.

The system is preferably sealed so that, in use, gas flows between the chambers with a one-way valve permitting free flow of gas from the skirt side of the piston to the other side during opening of the gate and compression of the spring and reverse motion is speed controlled by an adjustable bleed screw controlling flow of gas between the skirt and spring side of the piston.

In a preferred embodiment, the bleed screw is adjustable by a disengageable rotatable adjustor which is spring biased to a retracted position but manually depressible to engage an end of the bleed screw whereby rotation causes adjustment.

DESCRIPTION OF THE DRAWINGS

For illustrative purposes, preferred embodiments of the invention applicable to a closer for a swimming pool gate will now be described. In the drawings.

DETAILED DESCRIPTION OF THE DRAWINGS

Figure 1:
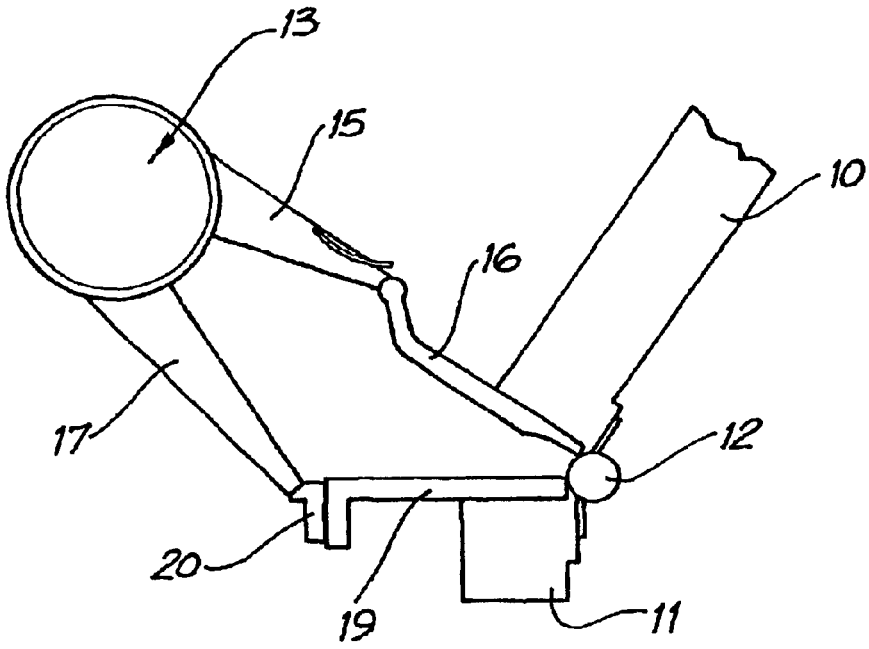
FIG. 1 is a schematic plan view of an embodiment of the invention applied to a swimming pool gate when partly open.
Figure 2:
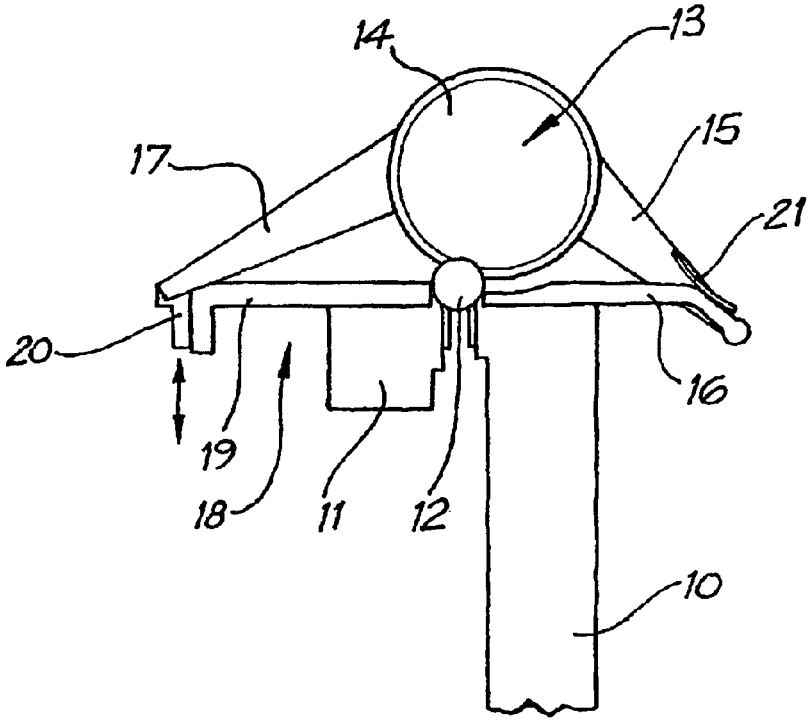
FIG. 2 is a view corresponding to FIG. 1 showing the gate opened to 180°.
Figure 3:
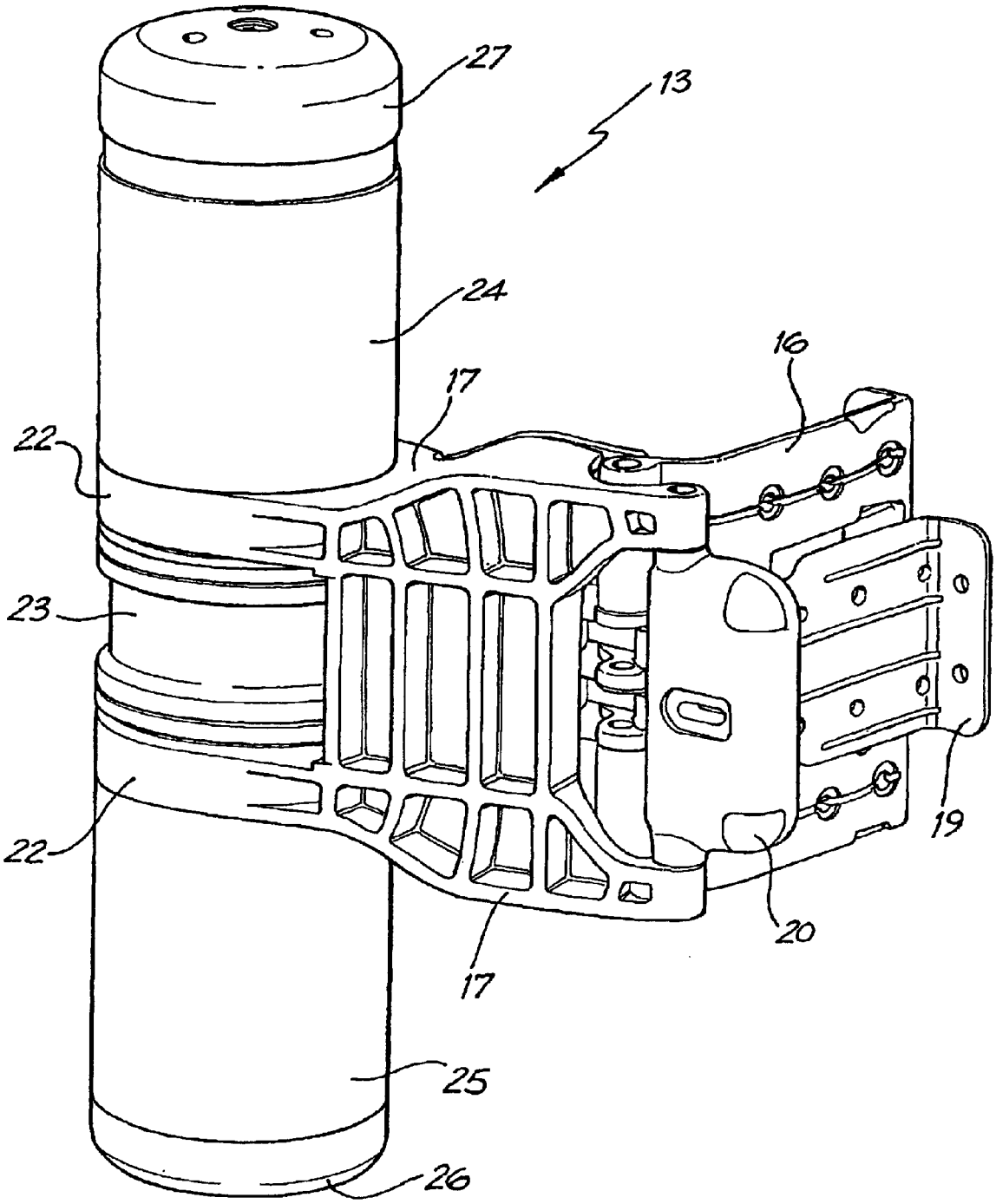
FIG. 3 is an isometric front view of the door closer prior to mounting on a gate.

Referring first to FIGS. 1 and 2, a gate 10 is mounted on a gate post 11 by conventional hinges 12, the gate being an outwardly opening swimming pool gate which is adapted to be opened through 180° and be controlled by a door closer 13 embodying the present invention.

The door closer has a cylindrical body 14 providing for automatic closure with controlled speed and having a first mounting arm 15 hingably connected about a vertical axis to a first mounting bracket 16 which is adapted to be attached to a vertical component of the gate 10. The closer has a second mounting arm 17 pivotally mounted at its extremity to a further mounting bracket 18 which is adapted to be fixed to the gate post 11; the mounting bracket 18 has an L-shaped base 19 and an adjustable plate 20 which is pivotally connected to the arm 17. Upon installation, the position of the plate 20 is adjusted in the direction of the arrows indicated before clamp screws are tightened to set the adjustment necessary to suit the particular hinging structure of the gate.

In this embodiment, there is a leaf spring 21 between the first arm 15 and the mounting bracket 16 because, at the 180° position shown in FIG. 2, the arms have reached a centre position and it is necessary reliably to initiate closing action. This is effected by the leaf spring 21 which is tensioned as the gate is moved near the closed position.

The arms 15 and 17 are relatively rotatable by virtue of the manner in which they are incorporated into the cylindrical body 14 which is shown in more detail in the remaining drawings. FIGS. 1 and 2 are schematic in terms of the forms of the arms and FIGS. 3–8 illustrate a more practical form where like reference numerals have been used for like parts.

In FIGS. 3–8, the mounting arm 17 is in the form of a yoke having ring shaped end portions 22 and the first arm 15 has an annular nut 23 relatively rotationally mounted relative to the yoke end portions 22. The body also has an upper cylinder 24 and a lower cylinder 25 which are screw threadably mounted on the yoke end portions 22, the body being terminated by a lower closure or dress cap 26 and an upper dress cap 27.

Figure 4:
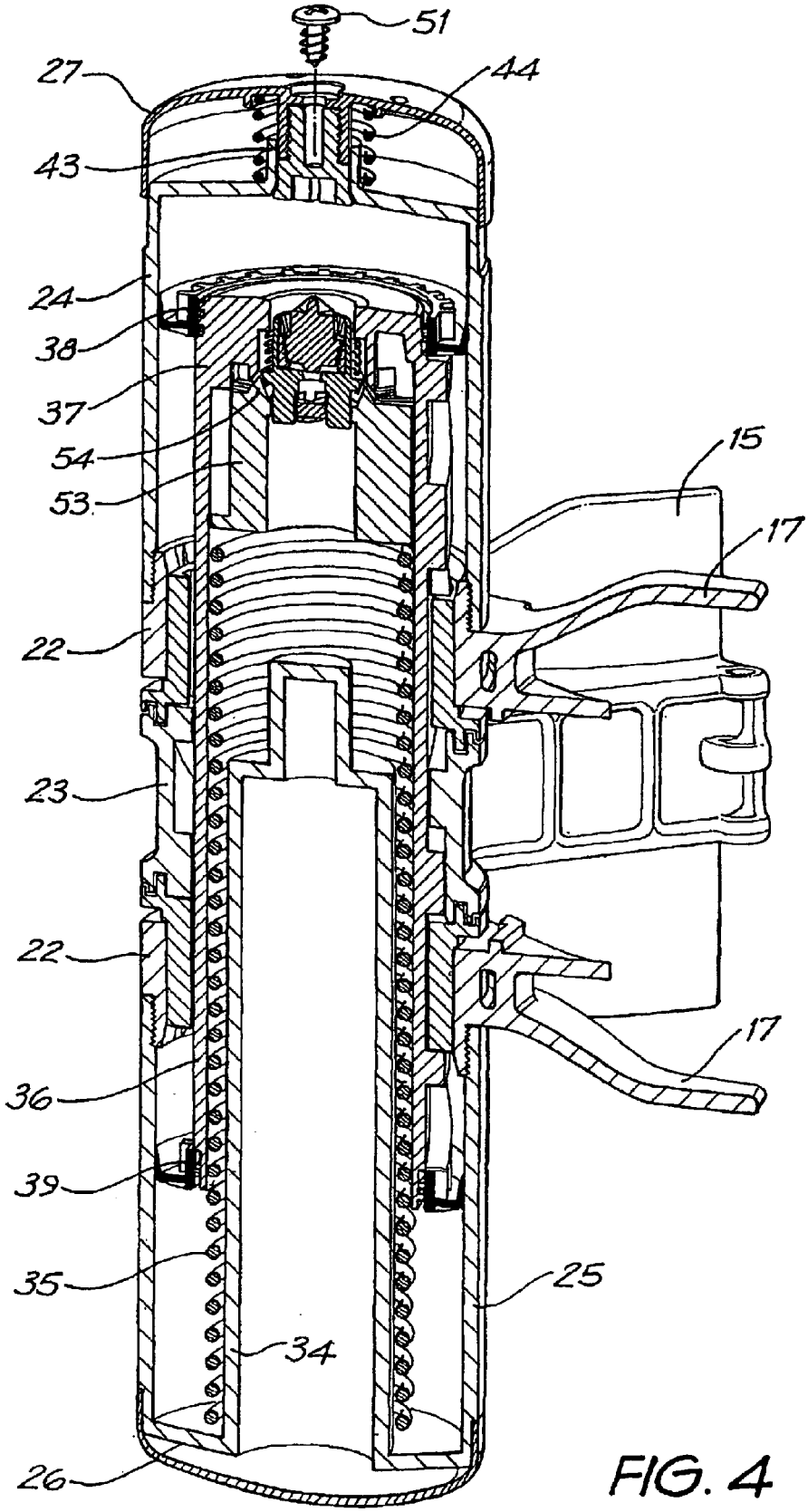
FIG. 4,shows in partial axial section the door closer of FIG. 3.
Figure 5:
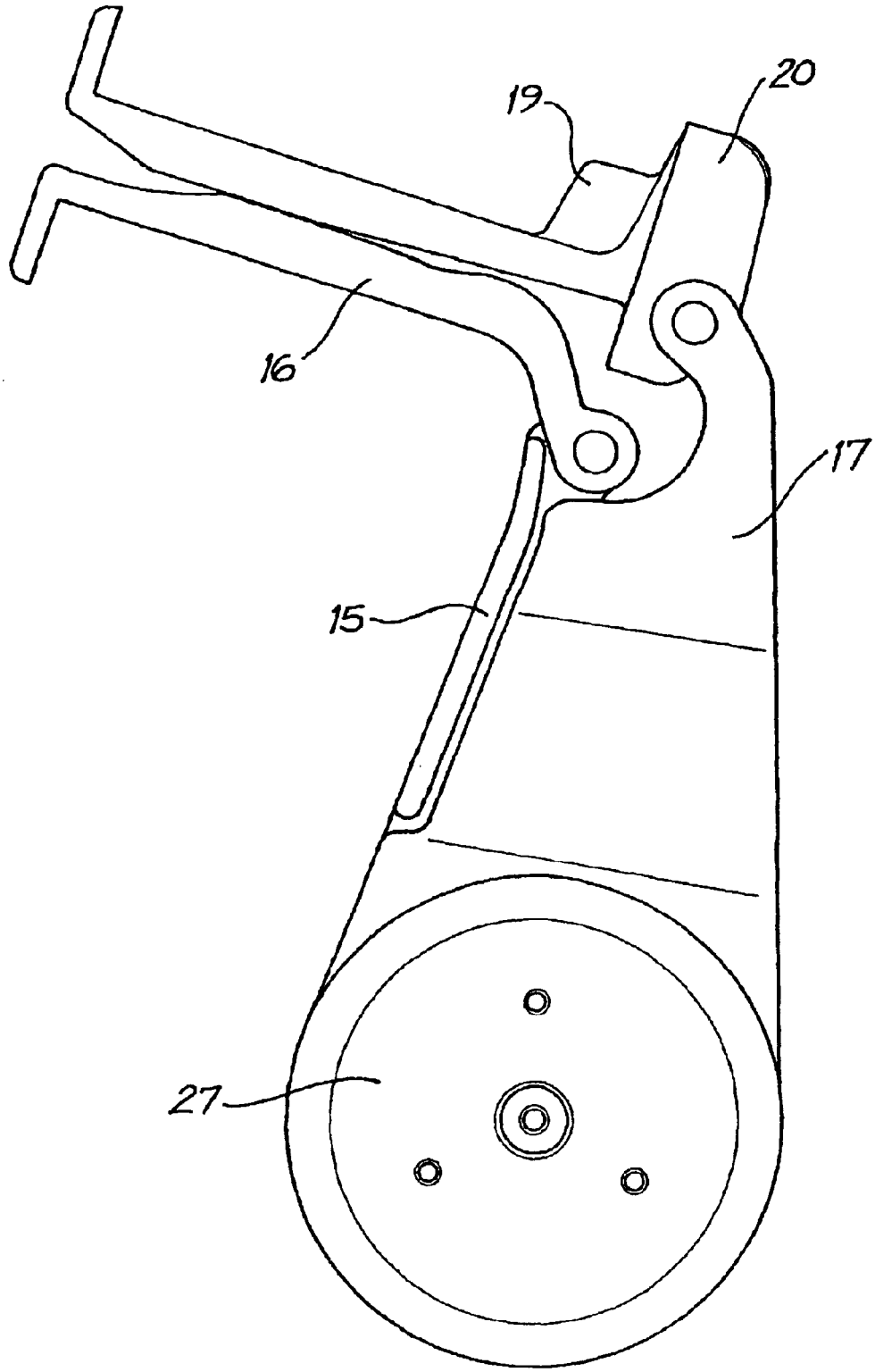
FIG. 5 is a plan view of the door closer.
Figure 7:
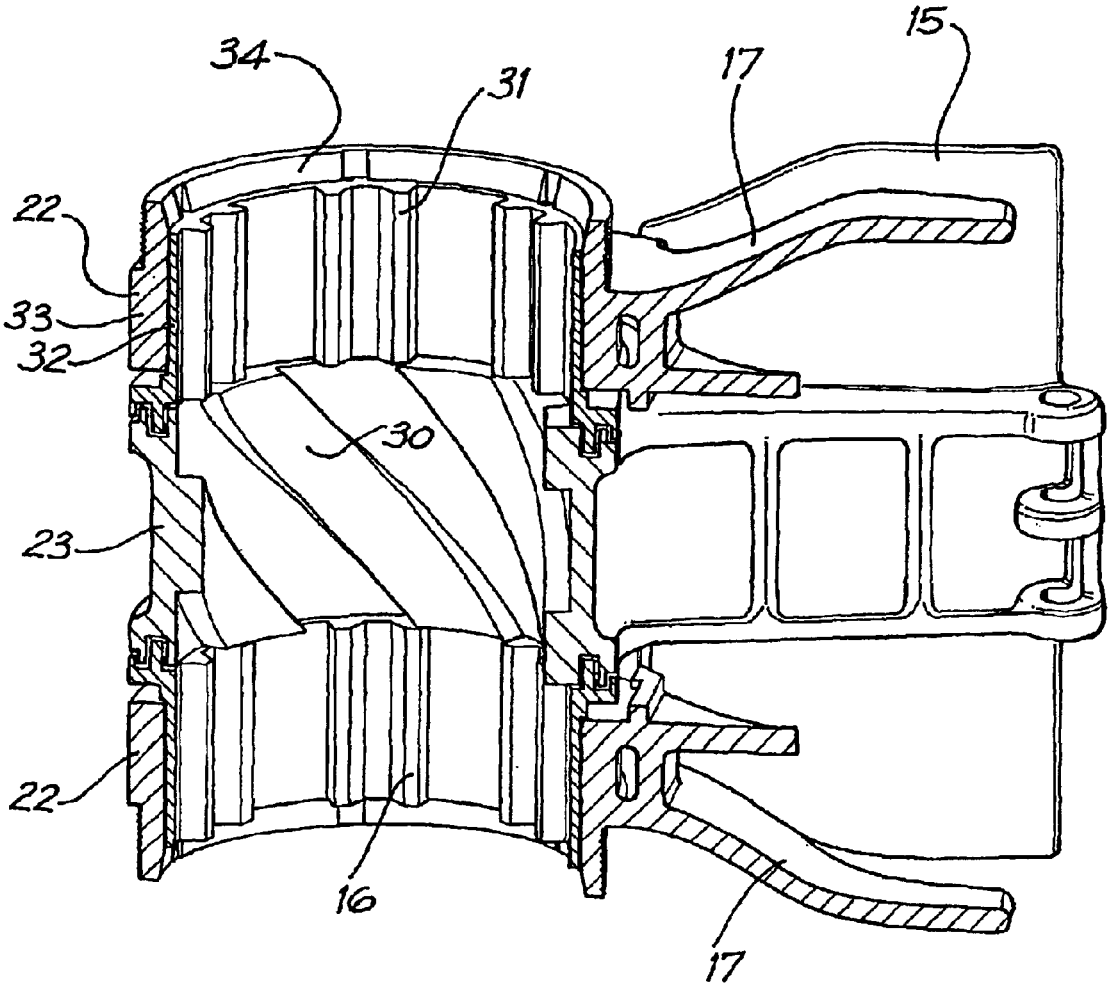
FIG. 7 is a sectional view showing interior detail of the central portion of the closer.

Referring now to FIG. 4, for clarity the mounting brackets 16 and 18 have been omitted together with part of the second mounting arm 17. The internal structure will now be described in more detail. The nut 23, integrally formed with the first arm 15, is relatively rotatably engaged by virtue of complementary end rings and grooves to annular yoke end portions 22. The interior of the nut 23 has spiral splines 30 (as best shown in FIG. 7). The yoke end portions 22, as shown in FIG. 7, incorporate internal axial splines 31 formed on an interior barrel 32 which is fitted to an outer barrel 33 of the end portion 22; the outer barrel 33 has interior grooves 34 in which exterior splines of the interior barrel 32 engage to prevent relative rotation.

Referring back to FIG. 4, the lower cylinder 25 is formed with an internal hollow spigot 34 which acts to locate a helical compression spring 35 and that in turn is located within an axially displaceable piston skirt 36 having a piston head 37, with bucket type ring seals 38 and 39 respectively mounted around the piston head and the bottom of the skirt for sealing engagement with the outer tubular cylinders 24 and 25.

Figure 6:
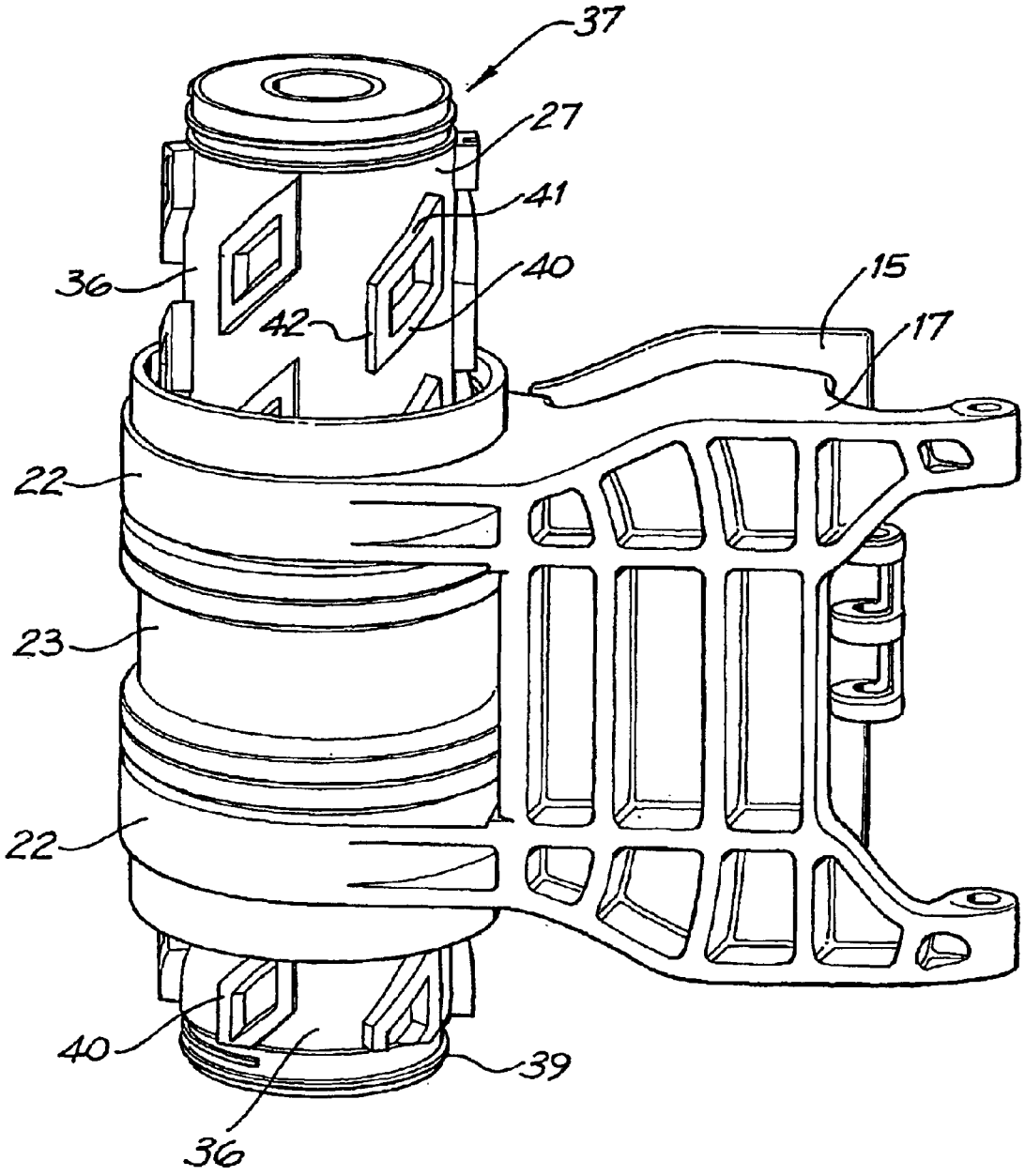
FIG. 6 is a partially assembled view only of the central components of the door closer.

The exterior of the skirt 36, as best shown in FIG. 6, has a series of lugs 40, each of generally rectangular form and having spiral side faces 41 and axial end faces 42 for inter-engagement firstly with the spiral splines 30 on the nut 23 and axial splines 31 associated with the yoke end portions 22, whereby rotation of the nut causes axial displacement of the piston.

Both the upper cylinder 24 and the lower cylinder 25 have screw threaded tip portions which engage in sealing engagement on assembly with a complementary shoulder at the axial ends of the yoke end portions 22 to provide a sealed structure. The upper cylinder 24 has a rotatable adjuster sealingly engaged in an axially projecting central boss 43, the adjustor having a helical spring 44 urging the adjustor cap 27 upwardly to a retracted position. On depression of the cap 27, when the piston is in the extreme position shown in FIG. 8, an adjustor element 50, which is sealingly retained in the boss 43 by a screw 51, engages the tip of an air bleed valve 52 to rotate it, thereby adjusting the valve and increasing or reducing the rate at which gas can pass therethrough from above the piston to below the piston.

Figure 8:
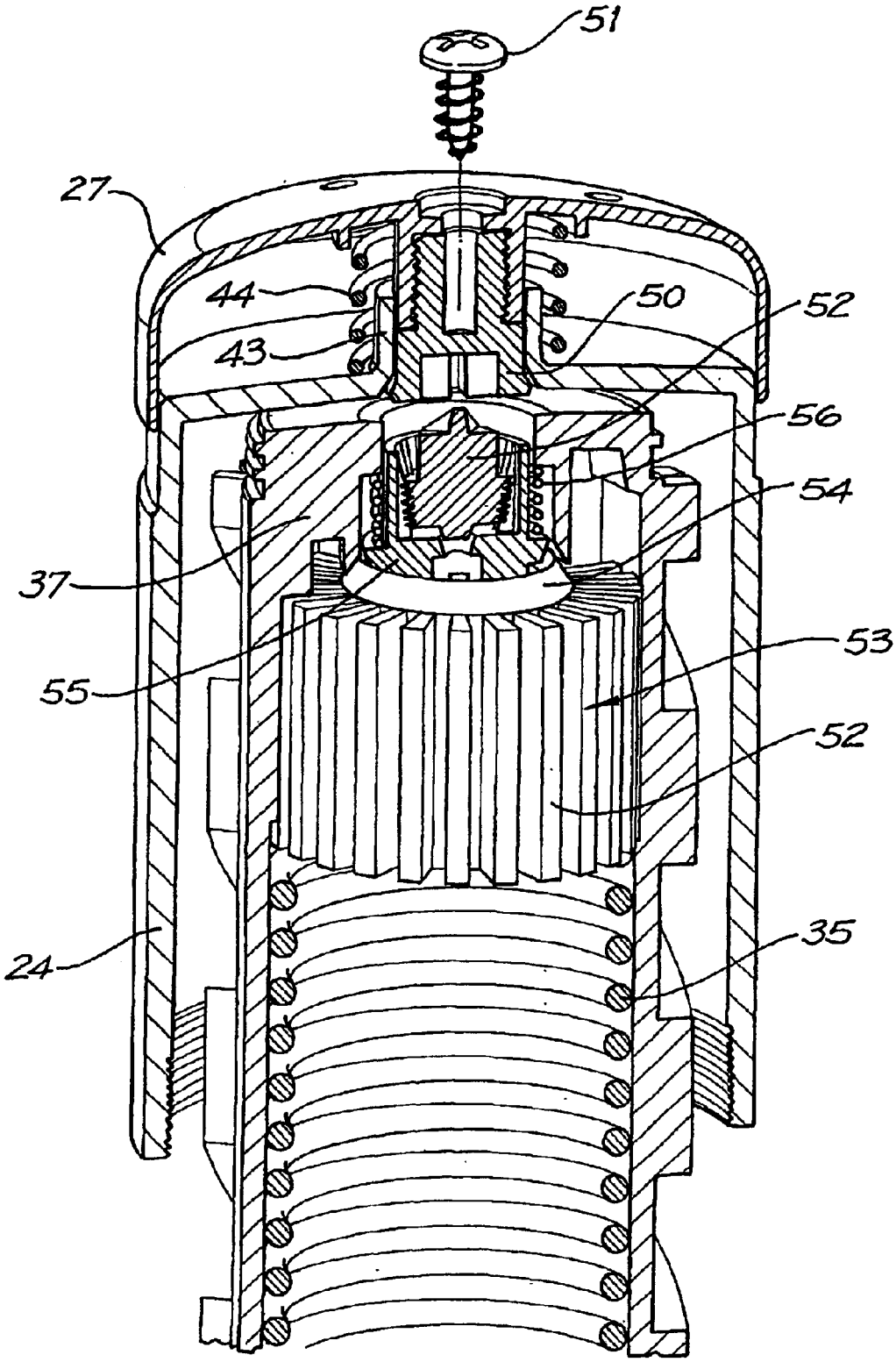
FIG. 8 is a view on an enlarged scale showing the upper portion of the closer in partial section with the piston moved to an upper limit position.

FIG. 8 also shows in detail peripheral splines 52 on the periphery of a relief valve body 53. These splines engage with corresponding splines on the interior of the upper portion of the skirt whereby the relief valve body 53 is restrained from rotation during adjustment of the bleed valve 52.

The relief valve body 53 has a double-coned collar 54 providing inner and outer valve seats. The inner seat cooperates with a valve base 55, the base 55 being biased onto the seat by spring 56, and the main spring 35 biaising the valve body 53 upwardly so that the outer cone seats on a correspondingly seat formed on the lower end of a passageway through the piston head.

In the event that an open gate is pushed rapidly towards the closed position, rotation of the nut occurs thereby driving positively the skirt upwardly and permitting the skirt to move ahead of the relief valve body 53 thereby providing for rapid airflow between the sealed respective sides of the piston head thereby obviating damage. During such positive fast gate closing, the valve body 53 is displaced downwardly relative to the piston head as the gas pressure about the piston exceeds the force on the valve body 53 from the spring 35.

Figure 9:
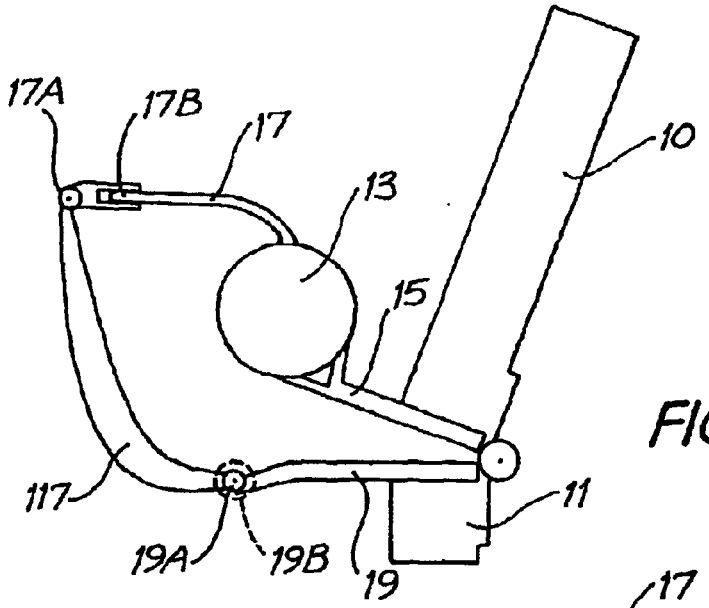
FIG. 9 is a schematic view corresponding to FIG. 1 of a second embodiment showing a plan view with a swimming pool gate slightly opened.
Figure 10:
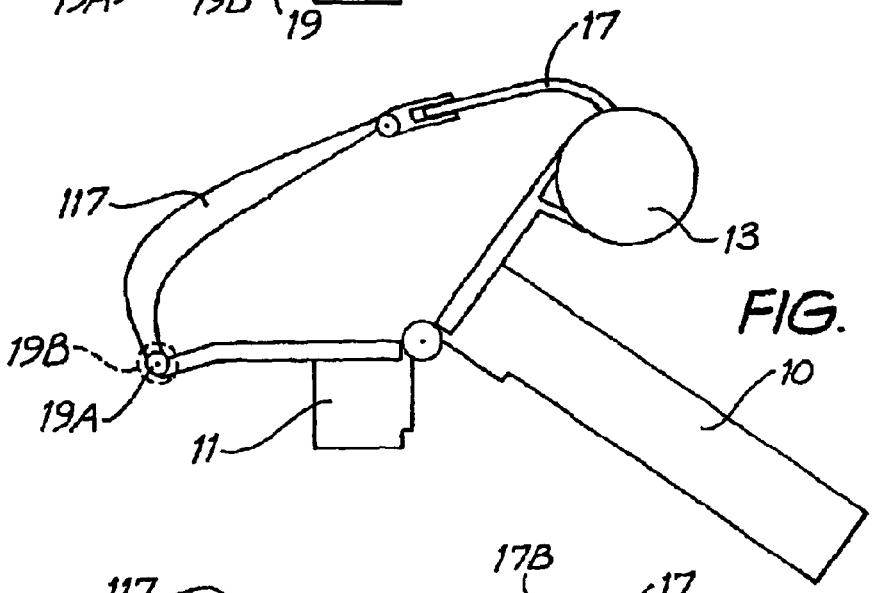
FIG. 10 shows the embodiment of FIG. 9 opened beyond 90 degrees.
Figure 11:
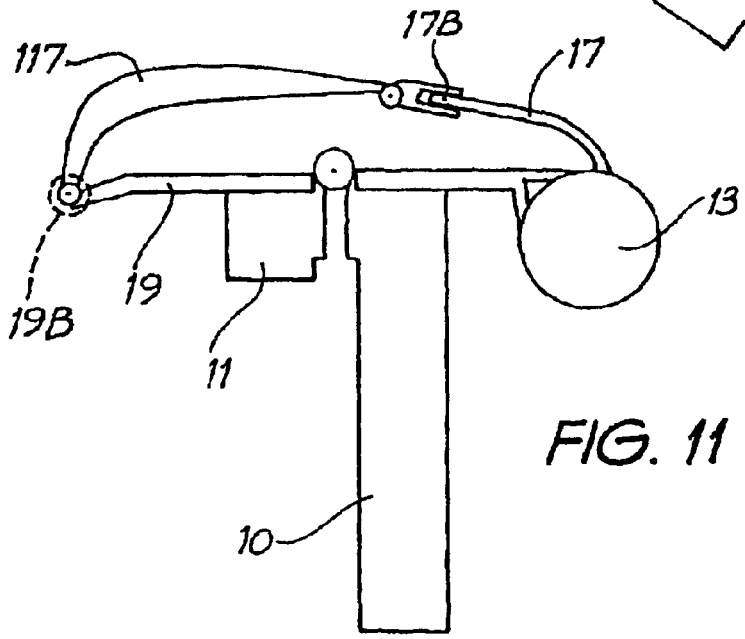
FIG. 11 shows the embodiment opened to approximately 180 degrees.

Reference is now made to FIGS. 9 to 11 which schematically show a second embodiment. The detailed structure for the cylinder unit can be implemented using the same detailed structure as described for the first embodiment although in this embodiment the form of the pivotal mounting arms differs but like reference numerals have been used for like parts. In this embodiment the closer 13 has a mounting arm 15 which is rigidly secured to an end face of the gate 10 whereas the second mounting arm 17 is mounted at its free end through a pivotal connection 17A to an intermediate arm 117 pivotally connected at 19A to base mounting arm 19 which is attached to the gate post 11.

In this embodiment the second mounting arm 17 contains an adjustable connection 17B to permit the length of the arm to be adjusted.

FIG. 10 shows the device with a gate in a normally opened position and FIG. 11 when the gate has been opened to about 180 degrees. This construction prevents damage to the gate closer if a user opens fully the gate beyond the normal portion shown in FIG. 10. This feature is important for a swimming pool gate application. In FIG. 11 the device has been opened fully to near "over centre". A separate closer initiating tension spring (shown schematically as 19B) is included in association with the mounting arms. When the gate is opened beyond about 90°, the tension spring is tensioned so as to initiate gate closing when the gate is released.

What is claimed is:

1. A closing device for a hinged gate and having a body portion and pivotal arms for respective connection directly or indirectly to a gate and gate post through respective mounting means being relatively rotational about an axis which is adapted to be parallel to the axis of hinging of the gate, the body portion and the arms being relatively rotational through a range of positions extending from a gate closed position through to a fully open position, one of the pivotal arms having mounting means adjacent to form a pivotal connection to a mounting arm which is adapted to be connected to either the gate or a gate post, the body portion having a cylindrical piston with an external grooved profile with a helical groove pattern and an axial groove pattern, a first of the pivotal arms having a helical ribbed mounting portion for mounting the pivotal arm for rotation of the arm about the piston as the piston moves axially and the second of the pivotal arms having an axially ribbed mounting element to engage the piston and guide its axial displacement during relative rotation of the pivotal arms, the body portion further providing a cylindrical housing for the piston with fluid chambers on each side of the piston, resilient dosing means to cause the gate to close when released in the open position and speed control means for controlling the speed of closure of the gate by controlling fluid flow between opposite sides of the piston.

2. A closing device as claimed in claim 1, wherein the connection arms provided to connect the device to a gate and gate post have a geometry and dimensions to permit the gate to be opened to at least nearly 180°.

3. A closing device as claimed in claim 1, and further comprising a fluid pressure release valve whereby any manual attempt to close the gate at a speed greater than that selected for automatic closure causes a valve mechanism to open thereby providing rapid additional fluid flow.

4. A closing device as claimed in claim 1 wherein the device includes the mounting means whereby, when installed, pivotal axes comprise: (a) the hinge axis of the gate and gate post, (b) the axis of the body portion of the device and (c) two pivot axes associated with the mounting means, the respective axes being parallel to one another.

5. A closing device as claimed in claim 4 wherein said two pivot axes are respectively provided transverse to and adjacent free ends of the respective pivotal arms, where pivot connections to respective mounting arms for the gate and gate post are provided.

6. A closing device as claimed in claim 4, wherein one of the pivotal arms is directly fixed to the gate or gate post and the other pivotal arm is pivotally connected at its free end to an intermediate pivot arm which, at its other end, is pivotally connected to a mounting arm which mounts to the other of the gate and gate post.

7. A closing device as claimed in 6 wherein the intermediate pivot arm includes an intermediate adjustment element providing for adjustment of a first end portion relative to the second end portion of the intermediate pivot arm whereby the axis of pivotal connection to said other pivot arm can be altered relative to the gate post to suit the particular installation required.

8. A closing device for a hinged gate having:

(a) a body portion, (b) a central axis of the body portion adapted to be located parallel to the hinge axis of the gate when in use, (c) first and second mounting arms extending from first and second relatively rotational portions of the body portion, the mounting arms having respective connector portions for connection respectively to a gate and a gate post, (d) the first and second portions of the body portion being relatively rotatable about the central axis, (e) the body portion having a cylinder with an axially moveable elongate piston in sealing engagement with an inner wall of the cylinder and the piston being adapted to be connected to the body portions to be driven axially upon relative rotational motion of the first and second portions of the body portion, (f) gas containing chambers being defined on opposite sides of the piston within the cylinder, (g) a spring mounted to be loaded during axial motion of the piston corresponding to rotation of the gate to an open position whereby on release of the gate, the spring biases the piston in a reverse direction, and (h) valve means provided for controlling the speed of the piston and thus closure of the gate when under bias from the spring, the valve means providing relatively free gas flow through the piston during gate opening and compression of the spring, and controlled gas flow for speed control during closing of the gate under spring pressure.

9. A device as claimed in claim 8, wherein the piston has a piston head and a depending skirt portion with ring seals provided around the piston, and the piston head incorporating a gas bleed valve to function as a speed control and a flap valve to permit unrestricted gas flow during gate opening.

10. A device as claimed in claim 8, wherein the piston head also incorporates a relief valve which opens to permit rapid additional gas flow through the piston if the gate is manipulated positively at high speed towards the closed position.

11. A device as claimed in claim 8, wherein the compression spring is in the form of a helical compression spring mounted over a mounting spigot and extending within the skirt of the piston, the spigot reducing the gas space within the cylinder on the spring side of the piston.

12. A device as claimed in claim 8, wherein one of the mounting arms comprises first and second arm elements forming a yoke with the arm elements interconnected for connection to a gate or gate post, the cylinder is formed from first and second portions which are mounted on the first and second arm elements and the first and second arm elements are rotatably mounted at opposite ends of a central element of the other of the mounting arms; the piston has a ring seal engaged within a first of the cylinder portions and the second axially spaced cylinder portion has a ring seal sealing a depending skirt of the piston.

13. A device as claimed in claim 12, wherein the central element includes an annular element with an interior structure to engage with a complementary structure on the periphery of the depending skirt of the piston whereby relative rotation of the annular element drives the depending skirt and the piston axially, the skirt having inter-engaging splines with the interior of the cylinder portions whereby its action is controlled to be purely axial; two gas chambers are defined on respective sides of the piston.

14. A device as claimed in claim 13, wherein the system is sealed so that, in use, gas flows between the chambers with a one-way valve permitting free flow of gas from the skirt side of the piston to the other side during opening of the gate and compression of the spring and reverse motion is speed controlled by an adjustable bleed valve controlling flow of gas between the skirt and spring side of the piston.

15. A device as claimed in claim 14, wherein the bleed valve is adjustable by a disengageable rotatable adjustor which is spring biased to a retracted position but manually depressible to engage an end of the bleed whereby rotation causes adjustment.

16. A closing mechanism for use in a gate closer device, the mechanism including a cylindrical element having a spiral relief profile and an axial relief profile formed around a cylindrical surface, an axially ribbed guide element adapted to engage with the relief profile and permit relative axial displacement of the cylindrical element, and complementary nut element arranged to engage with the spiral relief profile whereby rotational movement of the nut causes axial displacement of the cylindrical element and relative rotation of the guide element and the nut element, the cylindrical element being mounted in a cylinder with a spring which is energised by displacement of the cylindrical element in a first axial direction, the spring thereby providing a restoring force to move the cylindrical element in the opposite direction, and a fluid system associated with the cylindrical element and the cylinder having a fluid bleed system configured to control the speed of return motion of the cylindrical element under influence of the spring, the guide element and the nut element being adapted to have connection arms to be connected to a gate and gate post.

17. A device as claimed in claim 16, wherein the fluid system is a closed gas system.

18. A device as claimed in claim 16, wherein the connection arms are connected and can mount the device to a gate and gate post and to permit the gate to be opened to at least nearly 180°.

19. A device as claimed in claim 18, and further including an auxiliary spring to initiate closing of the gate, the spring being associated with the connection arms.

20. A device as claimed in claim 16, and further comprising a fluid pressure release valve operable upon any manual attempt to close the gate at a speed greater than that selected for automatic closure to open thereby providing rapid additional fluid flow to permit rapid movement of the gate.

* * * * *

UNITED STATES PATENT AND TRADEMARK OFFICE

CERTIFICATE OF CORRECTION

PATENT NO. : 6,904,642 B2
DATED : June 14, 2005
INVENTOR(S) : James David Francis West It is certified that error appears in the above-identified patent and that said Letters Patent is hereby corrected as shown below:

Column 7,
Line 20, correct the word "dosing" to -- closing --.

Signed and Sealed this

Twentieth Day of September, 2005

JON W. DUDAS
*Director of the United States Patent and Trademark Office*